US005785444A

United States Patent [19]

Matsuura

[11] Patent Number: 5,785,444

[45] Date of Patent: Jul. 28, 1998

[54] FASTENER

[76] Inventor: Toyoki Matsuura, No. 103 Ohtani, 7-chome Kasuga City, Fukuoka-ken, Japan

[21] Appl. No.: 685,511

[22] Filed: Jul. 24, 1996

[51] Int. Cl.[6] ..... B42F 13/06; B42F 13/08

[52] U.S. Cl. ..... 402/8; 402/7; 402/14; 402/15; 402/75; 402/80 R; 281/21.1; 281/29

[58] Field of Search ..... 402/7, 8, 14, 15, 402/4, 75, 80 R; 281/21.1, 29, 35, 37, 44; 412/4, 6, 7, 8

[56] References Cited

U.S. PATENT DOCUMENTS

| | | | |
|---|---|---|---|
| 1,238,410 | 8/1917 | Landsberg et al. . | |
| 1,372,161 | 3/1921 | Mills . | |
| 2,127,498 | 8/1938 | Westphal . | |
| 2,749,589 | 6/1956 | Carman, Jr. . | |
| 3,074,133 | 1/1963 | Jones . | |
| 4,285,104 | 8/1981 | Corey et al. | 24/153 |
| 4,305,675 | 12/1981 | Jacinto | 402/80 P |
| 4,386,795 | 6/1983 | Charles | 283/81 X |
| 4,498,828 | 2/1985 | Ackerman | 412/4 |
| 4,932,804 | 6/1990 | Richards | 402/52 X |
| 4,950,097 | 8/1990 | Blumberg | 402/14 X |
| 4,993,861 | 2/1991 | Blumberg et al. | 402/14 X |
| 5,007,758 | 4/1991 | Blumberg | 402/75 |
| 5,011,318 | 4/1991 | Gilmore | 402/14 |
| 5,037,228 | 8/1991 | Karlin | 402/80 R X |
| 5,423,624 | 6/1995 | Richards | 402/52 X |
| 5,667,322 | 9/1997 | Mucznik | 402/14 |
| 5,674,021 | 10/1997 | Hutnick | 402/14 |

*Primary Examiner*—Frances Han
*Attorney, Agent, or Firm*—Morrison Law Firm

[57] ABSTRACT

A fastener for binding documents having binding holes includes a fastening band and a back cover having binding holes. A layer of adhesive on one surface of the back cover is covered with a peel-off paper. The fastening band is inserted through the binding holes of the documents and the back cover. According to one embodiment, the fastening band includes a flat board part that holds the documents down and first and second clasp parts having engagement crenelations connected to both ends of the flat board part. The documents are securely bound by bending the first and second clasp parts to lock the engagement crenelations. Then, the peel-off paper is removed and the back cover is folded to conform to the documents and glued to the documents. According to another embodiment, the fastening band includes a flat board part having a narrow clasp part. The flat board part includes multiple spaced clamp holes. The clasp part is inserted into one of the clamp holes to bind the documents.

11 Claims, 3 Drawing Sheets

FASTENER

BACKGROUND OF THE INVENTION

This present invention relates to fasteners and, more particularly, to fasteners used to bind ledgers, documents or computer-generated tables for preservation and to prevent tampering.

Referring to FIG. 5, conventional binding utilizes binding cords 55 to bind ledger sheets 52. Binding is done by stacking a rear cover 51, ledger sheets 52 and a front cover 53 on top of each other. Next, binding cords 55 are passed through binding holes 54. Two or more rings (not shown) from two or three directions are utilized to maintain alignment. Finally, binding cords 55 are tied by knots (not shown).

Since binding with binding cords 55 requires passing binding cords 55 through binding holes 54 many times, the entire operation is difficult. Also, in order for binding to be successful, a user needs to be experienced. Binding cords 55 may loosen and unravel if they are not passed through binding holes 54 correctly and not properly tied. As binding cords 55 loosen, ledger sheets 52 are unaligned. In addition, binding cords 55 may break, letting ledger sheets 52 fall out.

Another drawback is that the exposed binding cords 55 detract from the overall appearance of the binding. Additionally, because knots (not shown) protrude from the binding, the bound ledger sheets 52 cannot be stacked in an orderly manner.

Other conventional binding fasteners include so-called ACCO fasteners which consist of a metal back with a pair of metal arms that are passed through binding holes and bent sideways to secure a stack of papers. In some applications, a clasp engages the ends of the metal arms to make the stack more secure.

A further conventional fastener includes metal posts passing through binding holes. In some cases the metal posts project rigidly from a rigid spine. The front ends of the posts may use a screw engaged therein to hold the stack of papers in place. In other cases, a cover may have a series of holes alignable with the posts which pass therethrough, and are secured.

OBJECTS AND SUMMARY OF THE INVENTION

Accordingly, an object of the present invention is to provide a fastener for binding documents which overcomes the drawbacks and limitations of the prior art.

Another object of the present invention is to provide a fastener that enables simple binding of documents such as ledger sheets and computer stock forms.

Another object of the present invention is to provide a fastener that prevents documents from falling out after binding.

A still further object of the present invention is to provide a fastener that is easy to use and does not require a user to have prior experience in binding operations.

Briefly stated, a fastener for binding documents having binding holes includes a fastening band and a back cover having binding holes. A layer of adhesive on one surface of the back cover is covered with a peel-off paper. The fastening band is inserted through the binding holes of the documents and the back cover. According to one embodiment, the fastening band includes a flat board part that holds the documents down and first and second clasp parts having engagement crenelations connected to both ends of the flat board part. The documents are securely bound by bending the first and second clasp parts to lock the engagement crenelations. Then, the peel-off paper is removed and the back cover is folded to conform to the documents and glued to the documents. According to another embodiment, the fastening band includes a flat board part having a narrow clasp part. The flat board part includes multiple spaced clamp holes. The clasp part is inserted into one of the clamp holes to bind the documents.

According to an embodiment of the invention, there is provided a fastener for assembling a stack of forms, the forms having a plurality of forms binding holes therein, including a back cover, a plurality of cover binding holes in the back cover alignable with the forms binding holes, at least one fastening band, the at least one fastening band including means for passing through at least two of the cover binding holes and the forms binding holes to align the stack of forms and a portion of the back cover, means for securing the fastening band to hold the forms in the stack, a layer of pressure-sensitive adhesive on a surface of the back cover, a peel-off paper covering the layer of adhesive, means for permitting the back cover to be folded over a front portion of the stack, a spine of the stack, and over a rear portion of the stack, with the layer of adhesive in contact with the spine and the rear, whereby the stack is retained, and the front portion and the rear portion including the fastening band, whereby the fastening band is covered and retained in place by the back cover.

According to an embodiment of the invention, there is provided a method for binding forms having binding holes, including stacking the forms and at least a back cover into a stack, inserting at least one clasp part of a fastening band into the binding holes, bending and locking the at least one clasp part to secure the forms, peeling off peel-off paper of the back cover exposing an adhesive, and bending the back cover so that the adhesive contacts and adheres to the forms and a back side of a back of the stack, whereby the forms are securely bound.

The fastener of this invention is characterized in that it includes a fastening band and a back cover. The fastening band includes a flat board part that holds the documents down and a clasp part that clasps the fastening band. The back cover has multiple binding holes. A layer of adhesive is formed on one surface of the back cover. Peel-off paper covers the layer of adhesive.

The fastening band has a flat board part in its middle. Clasp parts are connected to both ends of the flat board part. Multiple engagement crenelations connected to one edge are formed in a longitudinal direction on one clasp part. On the other clasp part, multiple engagement crenelations are formed on the opposite edge.

Alternatively, the fastening band has a flat board part formed on one of its ends in the longitudinal direction. A clasp part that is narrower than the flat board part is connected to the flat board part. Multiple spaced clasp holes, into which the clasp part is inserted, are provided on the flat board part.

A substance having plasticity is used for the fastening band. Polyvinyl chloride (PVC) coated sheet steel is a suitable substance.

A slit for partly peeling away peel-off paper is formed on a back cover. The slit near a boundary between a region glued to a back cover and a region glued to a rear cover when the back cover is folded in the binding process eases peeling away the peel-off paper.

The finished binding is attractive, because the fastening bands are hidden by the back cover. The documents are tightly bound by the clasp part, thereby ensuring that the documents will not come loose and fall out. The cover is thin, saving space and allowing orderly arrangement of the documents. Cover-binding is possible regardless of the number of binding holes in the documents.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1A:
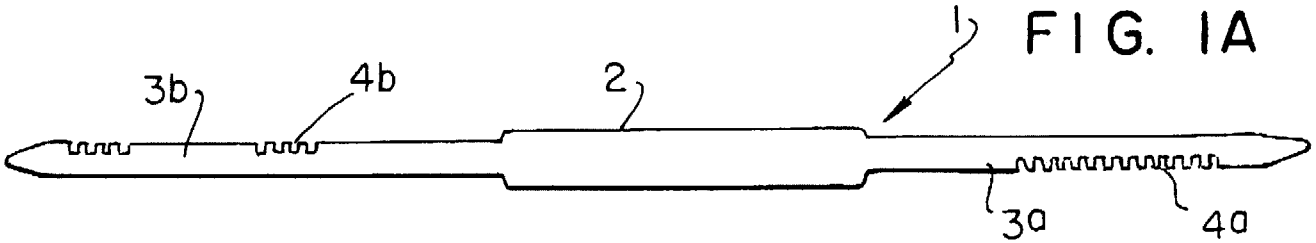
FIG. 1A shows a top view of a fastening band according to a first embodiment of the present invention.

Referring to FIG. 1A, a fastening band, shown generally at 1, includes a flat board part 2 in its center. Clasp parts 3*a*, 3*b* are integrally formed at opposed ends of flat board part 2. Multiple engagement crenelations 4*a* are formed in a longitudinal direction on an edge of clasp part 3*a*. Two sets of engagement crenelations 4*b* are spaced apart on an edge of clasp part 3*b* opposite to the edge on which engagement crenelations 4*a* are located.

Instead of forming two spaced-apart sets of engagement crenelations 4*b*, the entire edge of clasp part 3*b* may be crenelated. Fastening band 1 may be made of any suitable material such as plated steel sheet. For strength, ease of handling and other properties, fastening band 1 preferably is made out of polyvinyl chloride (PVC) coated sheet steel.

Figure 1B:
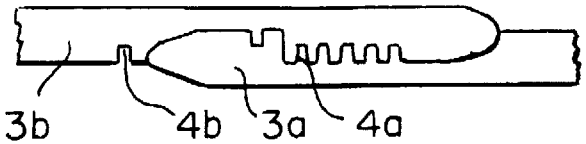
FIG. 1B shows a close-up top view of a portion of the fastening band of FIG. 1A showing engagement of crenelations of clasp parts of the fastening band.

Referring to FIG. 1B, engagement crenelations 4*a* on clasp part 3*a* engage engagement crenelations 4*b* on clasp part 3*b*. The widths of the notches on crenelations 4*a* and 4*b* are sufficient to permit the thickness of the material of their engaging partner to slide therein. The spacing between notches of at least one of engagement crenelations 4*a* and 4*b* should be sufficiently close together that reasonably tight binding of documents is enabled. For example, in many applications, a notch-to-notch spacing of about 1 mm is satisfactory.

Figure 2A:
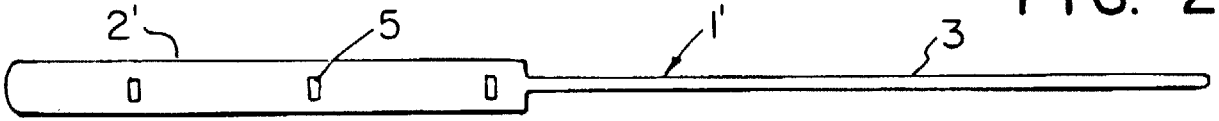
FIG. 2A shows a top view of a fastening band according to a second embodiment of the present invention.

Referring to FIG. 2A, a further embodiment of a fastening band, shown generally at 1', includes a flat board part 2' having an integrally formed single clasp part 3 extending from one end. Clasp holes 5 on flat board part 2' are sized to permit insertion of clasp part 3 therethrough during binding. Clasp holes 5 are spaced apart to accommodate a range of document thicknesses. Preferably, fastening band 1' is made of polyvinyl chloride (PVC) coated sheet steel or other material having suitable properties including the ability to maintain its shape after being bent.

Figure 2B:
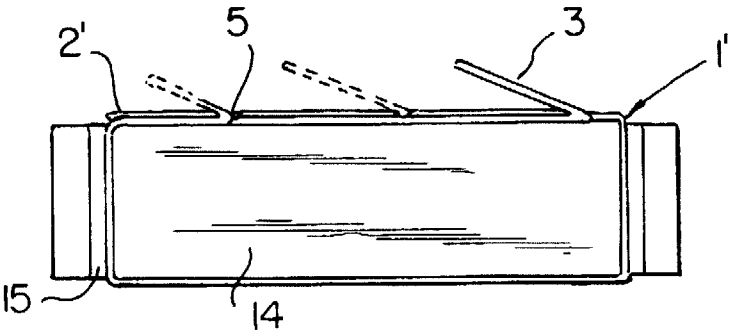
FIG. 2B shows a side view of the fastening band of FIG. 2A assembled to secure a stack of forms.

Referring to FIG. 2B, clasp part 3 passes through binding holes 15 of a document 14. An end of clasp part 3 is inserted from below into one of clasp holes 5 depending upon the thickness of document 14. Clasp part 3 is then bent backward on the outside of flat board part 2' to secure forms 14. Alternate locations for clasp part 3, for different thicknesses of forms 14 are shown in dashed line.

Figure 3A:
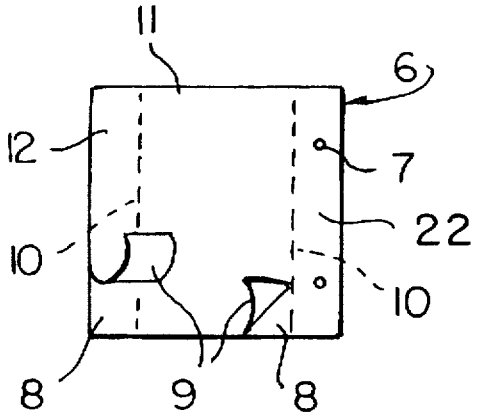
FIG. 3A shows a top view of a back cover sheet for size B5 documents according to an embodiment of the present invention.
Figure 3B:
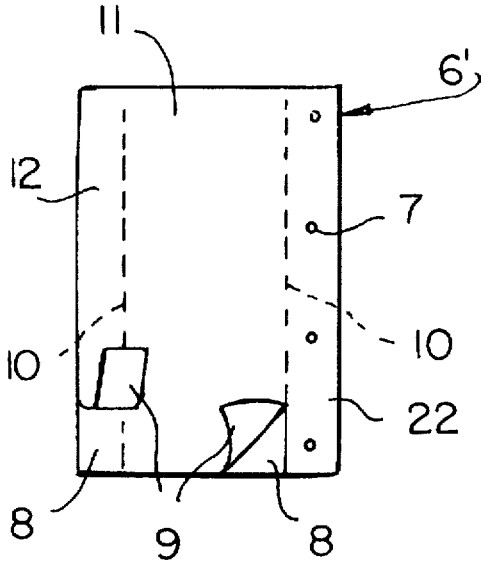
FIG. 3B shows a top view of a back cover sheet for size A4 documents according to an embodiment of the present invention.
Figure 3C:
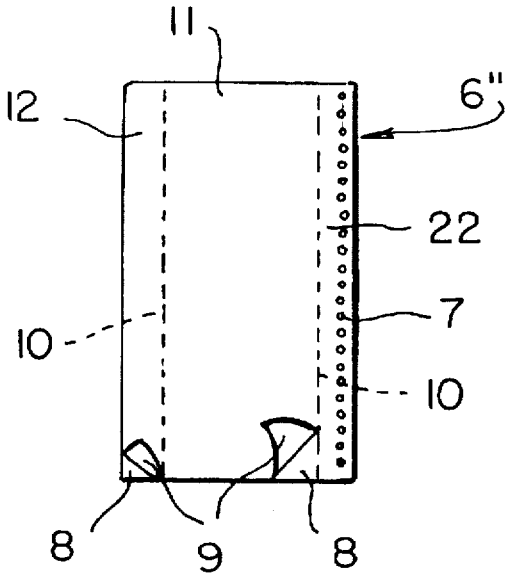
FIG. 3C shows a top view of a back cover sheet for computer-generated documents according to an embodiment of the present invention.
Figure 5:
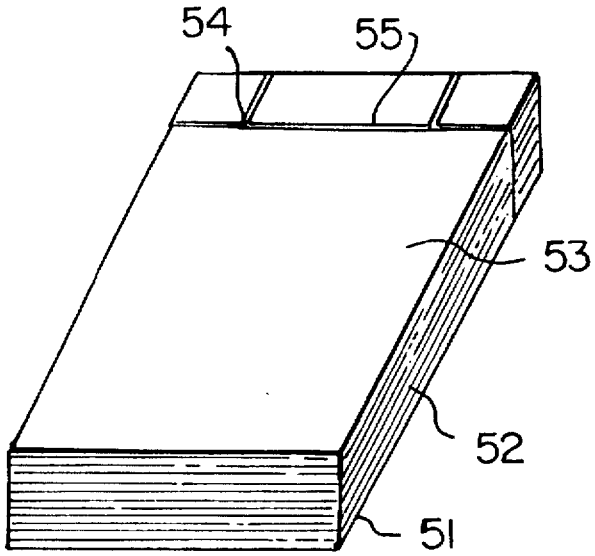
FIG. 5 PRIOR ART
FIG. 5 shows a perspective view of a conventional binding of ledger sheets with binding cords.

FIGS. 3A, 3B and 3C show back covers 6, 6' and 6" for document sizes B5, A4 and computer forms, respectively. These back covers are substantially alike, except for size, and number and placement of binding holes 7. Thus, the following description of back cover 6 for B5 documents, shown in FIG. 3A, is proffered as a description for all.

Referring to FIG. 3A, a back cover 6 for size B5 documents includes first and second binding holes 7. The size, number and spacing of binding holes 7 in back cover 6 is determined by the particular application, as indicated by a comparison of FIGS. 3A, 3B and 3C. Back cover 6 accommodates the document size, and the number and spacing of binding holes in the document (not shown) that are to be bound.

A binding region 22 defines an edge of back cover 6. Binding region 22 includes a plurality of binding holes 7 sized and spaced to align with binding holes (not shown) of a document to be assembled. A spine cover region 11 is connected to binding region 22 at a first precreased fold 10. A sheet of peel-off paper 9 covers substantially the entire rear surface of back cover 6. Peel-off paper 9 is slit at first precreased fold 10.

The opposite end of spine cover region 11 is connected to a back adhesive region 12 at a second precreased fold 10. A second slit in peel-off paper 9 is optionally aligned with second precreased fold 10. A layer of pressure-sensitive adhesive 8 underlies peel-off paper 9.

Figure 4:
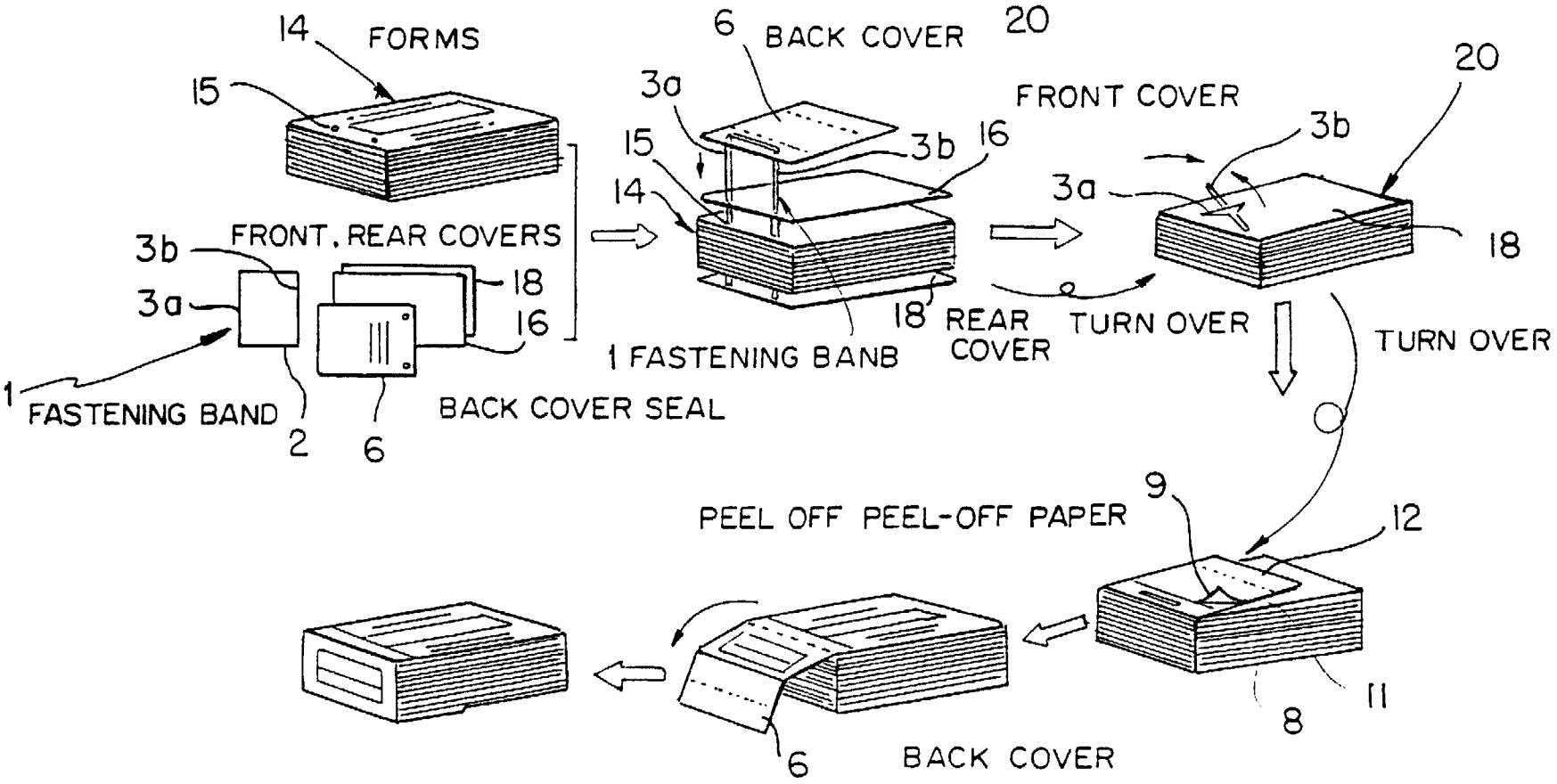
FIG. 4 shows the steps for binding forms using the fastener of the present invention.

Referring to FIG. 4, the process begins by stacking forms 14 face-up on a rear cover 18 with binding holes 15 aligned to form a stack 20. Clasp parts 3*a* and 3*b* of fastening band 1 are fitted through binding holes 7 in back cover 6. An optional front cover 16 is placed over stack 20 and clasp parts 3*a* and 3*b* of fastening band 1 are inserted through the aligned binding holes 15. Rear cover 18 is fitted over clasp parts 3*a* and 3*b* of fastening band 1 to complete stack 20.

The thus-formed stack 20 is turned over to permit fastening clasp parts 3*a* and 3*b* of fastening band 1. In the embodiment of FIG. 1A, the crenelations in clasp parts 3*a* and 3*b* are interlocked. In the embodiment of FIG. 2A, clasp part 3 initially passes through only a single one of binding holes 7 and 15. At this stage, the free end of clasp part 3 is passed through the second of binding holes 7 and 15, through a convenient one of clasp holes 5, and is bent backward flat against rear cover 18 to secure stack 20.

Secured stack 20 is again turned over. Peel-off paper 9 is removed from spine cover region 11 and back adhesive region 12. Back cover 6 is folded back along first precreased fold 10, and bent around the corner of the assembled stack 20 to bring adhesive 8 into contact with the ends of forms 14. Back adhesive region 12 is folded at the lower corner of stack 20 to bring adhesive 8 in that location into contact with the outer surface of rear cover 18, over the interlocked clasp parts 3*a* and 3*b* of fastening band 1.

Instead of following the above procedure, the stacking procedure may be started by inserting the clasp part(s) of fastening band 1 (1') through binding hole(s) of back cover 6, and then stacking forms 14 to produce stack 20. This technique has the advantage that the clasp part(s) provide guidance of binding holes 15 during the stacking. After completion of stacking of forms 14, front cover 16 may be installed, and clasp part(s) may be engaged as previously described. The remainder of the procedure is as previously described.

Upon completion of the above binding operation, pressure on the outer surface of spine cover region 11 and back adhesive region 12 adheres pressure sensitive adhesive 8 to the adjacent paper for a neat, stackable stack 20.

If large documents, such as computer-generated printouts as shown in FIG. 3C, are to be bound, a back cover 6" having more than two binding holes 7, preferably to match the number and spacing of at least a portion of the many binding holes normally existing in a fan-fold computer printout is used. Two or more fastening bands 1 (1') may be used side by side to form stack 20.

In some applications, peel-off paper 9 may be removed from binding region 22 so that this region also is adhered to the front of stack 20. Another alternative permits omitting one or both of front cover 16 and rear cover 18, thereby forming stack 20 using only forms 14.

Also, flat board part 2 (2') may be the same width as the clasp part(s) of fastening band 1 (1').

Having described preferred embodiments of the present invention with reference to the accompanying drawings, it is to be understood that the present invention is not limited to the precise embodiments, and that various changes and modifications may be effected therein by one skilled in the art without departing from the scope or spirit of the present invention which is limited only by the appended claims.

What is claimed is:

1. A fastener for assembling a stack of forms, said forms having a plurality of forms binding holes therein, comprising:

a back cover;

a plurality of cover binding holes in said back cover alignable with said forms binding holes;

at least one fastening band;

said at least one fastening band including means for passing through at least two of said cover binding holes and said forms binding holes to align said stack of forms and a portion of said back cover;

means for securing said fastening band to hold said forms in said stack;

a layer of pressure-sensitive adhesive on a surface of said back cover;

a peel-off paper covering said layer of adhesive;

means for permitting said back cover to be folded over a front portion of said stack, a spine of said stack, and over a rear portion of said stack, with said layer of adhesive in contact with said spine and said rear, whereby said stack is retained; and said front portion and said rear portion including said fastening band, whereby said fastening band is covered and retained in place by said back cover.

2. A fastener according to claim 1, wherein:

said fastening band includes a flat board part;

said means for passing through includes at least one clasp part integrally formed at an end of said flat board part;

said flat board part includes a plurality of spaced apart clasp holes; and said clasp part being fittable through said clasp holes whereby, when a portion of said clasp part fitted through a selected one of said clasp holes is bent over, said stack is secured.

3. A fastener according to claim 1, wherein:

said fastening band includes a flat board part;

said means for passing through includes first and second clasp parts integrally formed at opposed ends of said flat board part;

said first clasp part including a plurality of engagement crenelations at a first edge thereof;

said second clasp part including at least one engagement crenelation in a second edge thereof;

said first edge facing said second edge when said first and second clasp parts are folded toward each other;

at least one of said plurality of engagement crenelations being engageable with said at least one engagement crenelation for securing said first and second clasp parts together, whereby said stack is secured.

4. A fastener according to claim 3, wherein said second clasp part includes a plurality of engagement crenelations spaced from each other.

5. A fastener according to claim 3, wherein said second clasp part includes continuous engagement crenelations.

6. A fastener according to claim 3, wherein a crenelation spacing of said plurality of engagement crenelations is about 1 mm.

7. A fastener according to claim 1, wherein:

said back cover includes at least first and second slits for partially peeling off said peel-off paper exposing said layer of adhesive;

said first slit being disposed at a boundary between a first region of said back cover to be glued to said forms and a second region of said back cover to be glued to a rear cover of said forms when said back cover is folded back during binding.

8. A fastener according to claim 1, wherein said fastening band is polyvinyl chloride (PVC) coated sheet steel.

9. A method for binding forms having binding holes, comprising:

stacking said forms and at least a back cover into a stack;

inserting at least one clasp part of a fastening band into said binding holes;

bending and locking said at least one clasp part to secure said forms;

peeling off peel-off paper of said back cover exposing an adhesive; and bending said back cover so that said adhesive contacts and adheres to said forms and a back side of a back of said stack, whereby said forms are securely bound.

10. A method for binding forms according to claim 9, wherein said fastening band is polyvinyl chloride (PVC) coated sheet steel.

11. A method for binding forms according to claim 9, wherein said stack includes a front cover and a rear cover.

* * * * *